US005272953A

United States Patent [19]

Koch

[11] Patent Number: 5,272,953

[45] Date of Patent: Dec. 28, 1993

[54] STRING WINDER TOOL FOR MUSICAL INSTRUMENT

[75] Inventor: Virgil A. Koch, Colleyville, Tex.

[73] Assignee: Advanced Innovative Technologies, Inc., Colleyville, Tex.

[21] Appl. No.: 855,901

[22] Filed: Mar. 23, 1992

[51] Int. Cl.[5] ..... G10G 7/00

[52] U.S. Cl. ..... 84/458; 84/304

[58] Field of Search ..... 84/453, 454, 458, 304, 84/306

[56] References Cited

U.S. PATENT DOCUMENTS

| | | | |
|---|---|---|---|
| 510,375 | 12/1893 | Ayuso | 84/306 |
| 1,669,824 | 5/1928 | Grover | 84/304 |
| 1,802,937 | 4/1931 | Bertram | 84/304 |
| 2,812,682 | 8/1955 | Longone et al. | 84/304 |
| 3,431,807 | 3/1969 | Thompson | 34/306 |
| 3,706,254 | 12/1972 | Morin | 84/458 |
| 4,278,002 | 7/1981 | Siminoff | 84/304 |
| 4,498,366 | 2/1985 | Carr | 84/304 |
| 4,748,889 | 6/1988 | Schaller | 84/304 |
| 4,791,849 | 12/1988 | Kelley | 84/458 |

*Primary Examiner*—Michael L. Gellner
*Assistant Examiner*—P. Stanzione
*Attorney, Agent, or Firm*—Dennis T. Griggs

[57] ABSTRACT

A musical instrument string winder for engaging a musical instrument knob (e.g. guitar knob) for tightening or loosening a musical instrument string includes a knob socket and a turning handle. The knob socket has an integral gear on one end and a recess for engaging a musical instrument knob on another end. The handle has an integral gear on one end and a substantially flat gripping portion on another end. The handle gear has a predetermined number of teeth which is at least more than half the number of teeth on the knob socket integral gear. A gear housing supports first and second idler gears, with the handle integral gear being engaged with the first idler gear, and with the knob socket integral gear being engaged with the second idler gear. The musical instrument string winder thus provides more than one rotation of the musical instrument knob for every one rotation of the handle.

12 Claims, 2 Drawing Sheets

STRING WINDER TOOL FOR MUSICAL INSTRUMENT

FIELD OF THE INVENTION

This invention relates generally to accessories for stringed musical instruments, and in particular to string tuning/winding devices.

BACKGROUND OF THE INVENTION

In guitars and other stringed musical instruments, strings, typically of different diameters, are stretched across a bridge over a resonant box. The strings terminate on revolving pegs or stems on a headstock connected to the box. Each string is separately tuned to a note on an appropriate key by rotating the winder stem to adjust the string tension. In playing the instrument, the musician effectively alters the length of each string by pressing the string with a finger against a fret to shorten the string length and produce the vibrational frequency associated with the selected note.

In common usage, a musician from time to time encounters a broken or malfunctioning string, thus requiring a string change. If the old string is intact, it must be fully unwound before the new one can be installed. After selecting the new string, even if cut to an appropriate length, there is still considerable slack which must be eliminated by winding the string around the string winder stem. Conventional winding tools are flat or disc-shaped and require a twisting motion of the thumb and forefinger. For many years, crank-type tools have been available to facilitate a somewhat easier twisting motion, thereby accelerating tightening or loosening the strings while they are being changed. Such tools have included handles rotatable relative to an arm, and an underlying receptacle to receive and grip the knob of the tuning machine. The tool is then cranked, thereby tightening or loosening a selected string.

OBJECTS OF THE INVENTION

From the foregoing discussion, it can be seen that the conventional technique of loosening or tightening a musical instrument knob can be a lengthy process. This slow process may interfere with the musician's performance.

Accordingly, the principal object of the present invention is to provide a method and apparatus to facilitate loosening or tightening of musical instrument strings.

It is a further object of the present invention to provide a method and apparatus which reduces the number of turns necessary to provide a given amount of string loosening or tightening.

It is still a further object of this invention to provide a tool for loosening or tightening a musical instrument string which is easily gripped, provides a lever arm to give greater leverage on turning the winder stem while providing for more than one rotation of the musical instrument stem for each crank of the winder tool.

SUMMARY OF THE INVENTION

It has been found that a great deal of manual effort is required to tighten or loosen strings of a musical instrument such as a guitar. Conventional tools have not provided more than one rotation of the stem for each crank of the tool.

This problem is overcome according to the present invention by a musical instrument string winder including a knob socket having an integral gear on one end and a socket for engaging a string winder knob on another end, the knob socket having a predetermined number of teeth; a handle having an integral gear on one end and a substantially flat gripping portion on another end, and the handle integral gear having a predetermined number of teeth. To produce more than one turn of the musical instrument knob for each crank of the handle, the number of teeth in the handle integral gear should be at least more than half the number of teeth of the knob socket integral gear.

It will be appreciated that less than one turn of the musical instrument knob will be produced for each turn of the handle where the number of teeth in the handle integral gear is less than half the number of teeth of the knob socket integral gear. The turn ratio can thus be adjusted, as desired, to be less than 1:1 or greater than 1:1 according to the ratio of the number of teeth in the handle integral gear relative to the number of teeth in the knob socket integral gear. By selecting the number of teeth in the handle integral gear to be more than half the number of teeth in the knob socket integral gear, a turn ratio of more than 1:1 is produced. If the handle integral gear and the knob socket integral gear are constructed with an equal number of teeth, the musical instrument string winder will produce exactly two rotations of the musical instrument stem for every one rotation of the handle. If the handle integral gear has more teeth than the knob socket integral gear, the musical instrument string winder will provide more than two rotations of the string winder stem for every on rotation of the handle.

The gear housing preferably includes at least first and second idler gears with the handle integral gear being engaged with the first idler gear, and with the knob socket integral gear being engaged with the second idler gear While the gear housing preferably has only two idler gears, it could, for example, have an idler gear string of four idler gears. The idler gear string is useful in certain embodiments for providing an effective lever arm of a desired length for mechanical advantage, while minimizing the profile width of the tool. It will be appreciated, however, that the idler gear string can be omitted, with the handle integral gear and knob socket integral gear being directly coupled with their respective teeth being intermeshed with each other. The directly coupled embodiment may be used to good advantage for those applications in which physical size is not a limiting factor.

Preferably the handle, the knob socket, and the gears are fabricated of moldable polymer material. The idler gears are rotatably mounted on axles on the gear housing and screws are used to rotatably mount the handle and the knob socket on the gear housing. The screws have heads with a circular periphery where the gear housing has countersunk blind bore openings which receive the screw heads.

The invention also provides a method for musical instrument string winding utilizing a musical instrument string winder to engage a musical instrument knob for tightening or loosening a musical instrument string. The method utilizes engaging a musical instrument knob with a musical instrument stem winder. The musical instrument stem winder has a knob socket, a gear housing, and a handle. The knob socket has an integral gear on one end and a recess for engaging a musical instrument knob on another end. The handle has an integral gear on one end and a substantially flat gripping portion on another end. The handle integral gear has a predetermined number of teeth which, for string winding applications, is preferably at least more than half the number of teeth of the knob socket integral gear. The gear housing has at least first and second idler gears, with the handle integral gear being engaged with the first idler gear, and with the knob socket integral gear being engaged with the second idler gear. The method further utilizes holding the substantially flat gripping portion of the handle and rotating the handle without allowing the instrument to rotate, whereby the musical instrument string winder tool can provide more than one rotation of the winder stem for every one rotation of the handle.

DESCRIPTION OF THE PREFERRED EMBODIMENT

Figure 1:
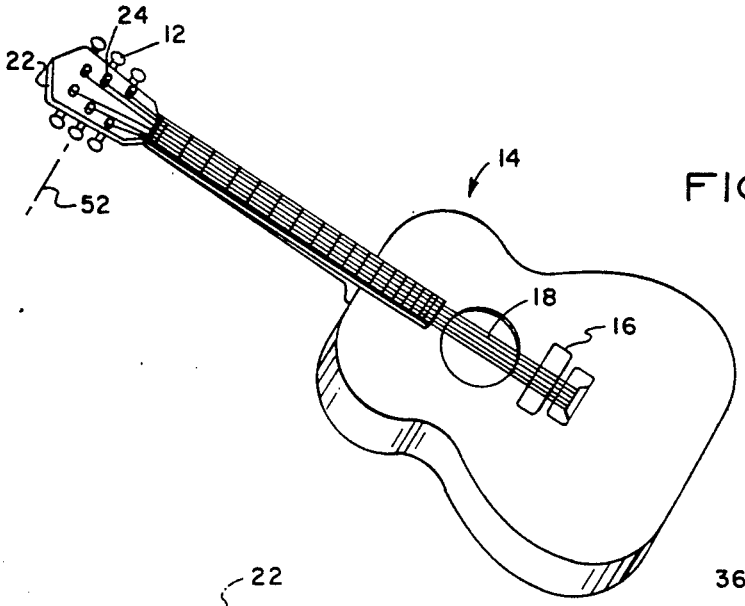
FIG. 1 is a perspective view of a guitar, with which the present invention may be employed.
Figure 2:
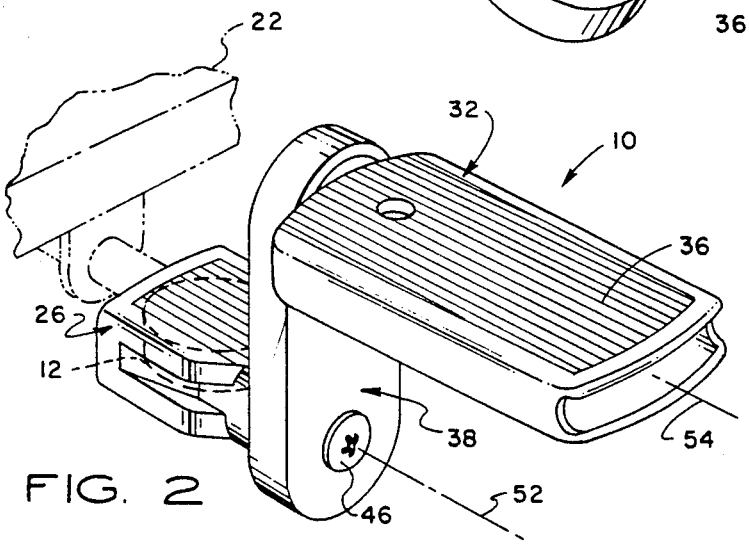
FIG. 2 is a perspective view of the musical instrument string winder tool, shown engaged with a guitar string winder knob.

FIGS. 1 and 2 illustrate a musical instrument string winder tool 10 which can be engaged with a string winder knob 12 to tune and/or change the strings of a guitar 14. Although applicable to stringed musical instruments in general, a guitar will be used herein as an example. The guitar 14 is provided with a bridge 16 over which strings 18 extend from an anchoring plate 20 to the headstock 22 of the guitar, where the strings 18 are rolled around rotatable tightening shafts or stems 24. Each stem 24 is coupled by a worm gear (not shown) for rotation directly or indirectly in response to turning movement of the guitar knob 12.

Figure 7:
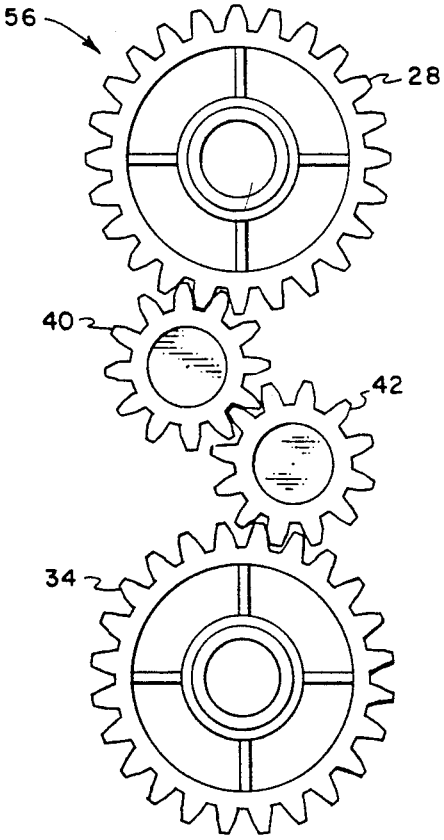
FIG. 7 shows a typical gear layout with a handle gear, two idler gears and a socket gear; and, FIG. 8 shows a top view of a gear housing for the musical instrument string winder.

In FIG. 2, the musical instrument string winder 10 is shown in perspective. The musical instrument string winder 10 has a knob socket 26 with an integral gear 28 on one end and a recess 30 for engaging the guitar knob 12 on the other end. The handle 32 has an integral gear 34 on one end and a substantially flat gripping portion 36 on the other end. The gear housing 38 contains first and second idler gears 40, 42 (FIG. 7). The knob socket integral gear 28 is connected to the handle integral gear 34 through the two idler gears 40, 42.

Figure 3:
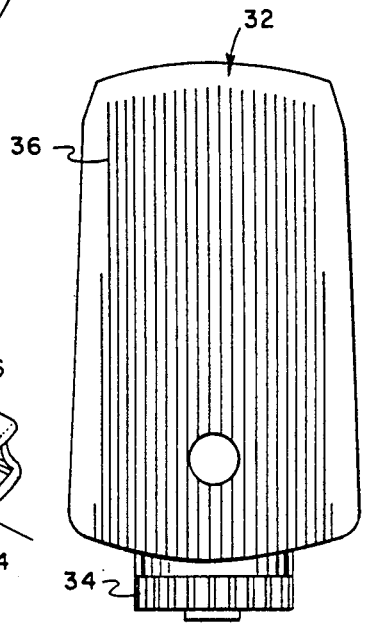
FIG. 3 shows a handle of a musical instrument string winder tool, having an integral gear on one end and a substantially flat gripping portion on the other end.
Figure 4:
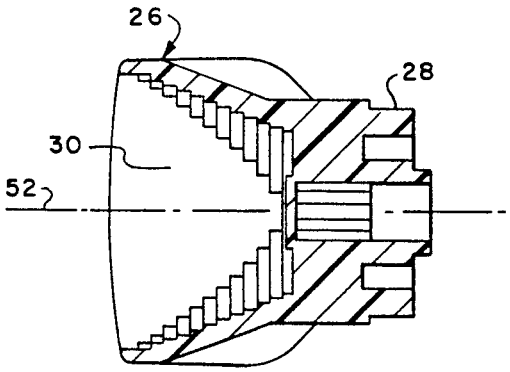
FIG. 4 shows a cross section of a knob socket, showing an integral gear on one end and a recess on the other end, with the recess being shaped to receive a musical instrument knob, such as a guitar knob.
Figure 5:
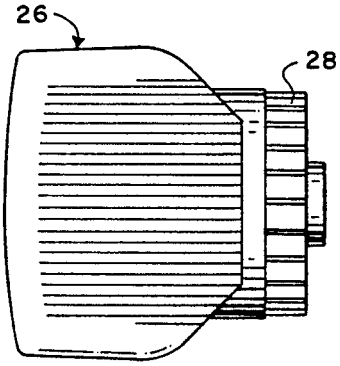
FIG. 5 shows a side elevation of the knob socket.

A comparison of FIGS. 2 and 3 indicates the paddle shape of the handle 32. FIG. 3 also shows that the integral gear 34 is part of the handle 32. FIG. 4 shows the recess 30 into which the guitar knob 12 fits, and FIG. 5 shows that the integral gear 28 is part of the knob socket 26.

Figure 6:
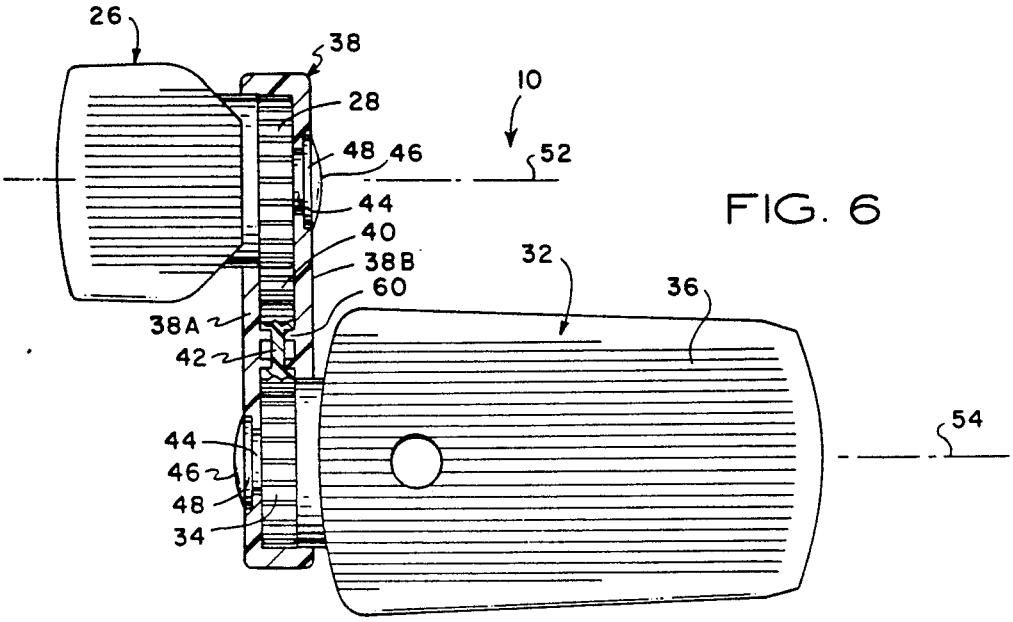
FIG. 6 shows an assembled musical instrument string winder tool.
Figure 8:
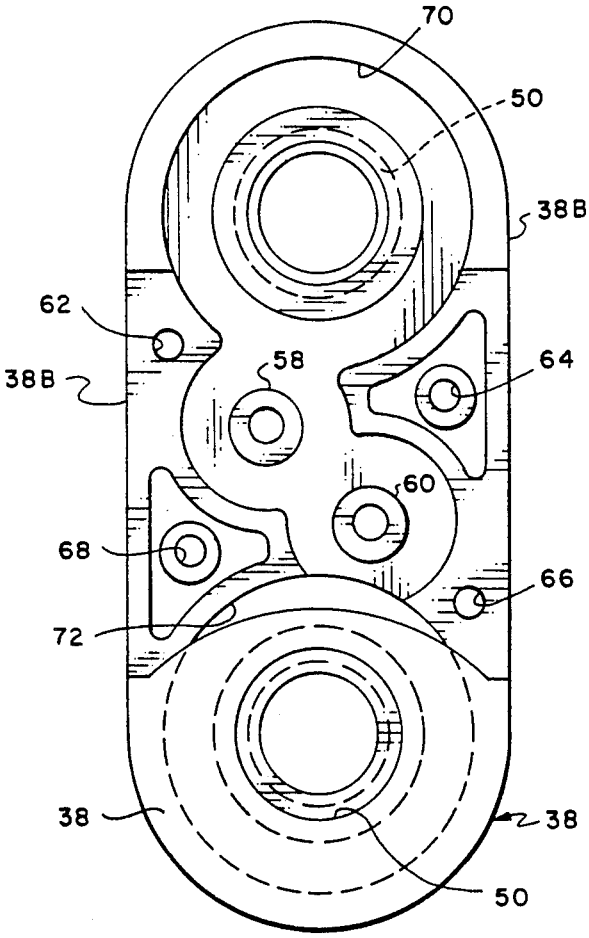

FIGS. 6–8 show the relationship of the knob socket 26 and handle 32, each with integral gears 28, 34, respectively, and the gear housing 38. The gear housing 38 has two mating sections 38A, 38B which contain the two idler gears 40, 42. Screws 44 hold the knob socket 26 and the handle 32 and allow them to be rotatably mounted in the gear housing 38. In particular, the screws 44 have heads 46 with a circular edge 48, and the gear housing sections 38A, 38B have countersunk bores 50 to receive the screw heads 46.

As long as the handle integral gear 34 has at least more than half the number of teeth of the knob socket integral gear 28, the string winder tool 10 provides for faster rotation of the winder stem and guitar knob 12 than of the handle 32. Note that, as used herein, "rotation of the handle" refers to rotation of the handle 32 about the common axis 52 of the guitar knob 12 and knob socket 26 (not rotating on handle axis 54). That is, the generally flat gripping portion 36 of the handle 32 is held by the operator's hand and does not rotate about the handle axis 54. The flat shape of the handle 32 reduces any tendency of the handle 32 to rotate around its own axis 54. Thus, the gripping surface 36 of the handle 32 remains parallel to a vertical plane as the tool 10 is operated and the handle 30 rotates around the guitar knob and knob socket common axis 52.

FIG. 7 shows a gear train 56 in which the knob socket gear 28 and the handle gear 34 are the larger gears on the end of the gear train and the two idler gears 40, 42 are shown offset in the middle. The idler gears could be arranged in line, if desired, for greater leverage. In this particular configuration, the knob socket integral gear 28 has the said number of teeth as the integral gear 34 in the handle 32, and the string winding tool 10 thus can provide two rotations of the gear knob 12 for every one rotation of the handle 32. If the musical instrument string winder 10 has an integral handle gear 34 with more teeth than the knob socket gear 28, the musical instrument string winder 10 provides more than two rotations for every rotation of the handle 32. It will be appreciated that less than one turn of the musical instrument knob 12 will be produced for each turn of the handle 32 where the number of teeth in the handle integral gear 34 is less than half the number of teeth in the knob socket integral gear 28. The turn ratio can thus be adjusted, as desired, to be less than 1:1 or greater than 1:1 according to the ratio of the number of teeth in the handle integral gear relative to the number of teeth in the knob socket integral gear.

Generally, two idler gears have been found to be preferable, providing an appropriate lever arm for the winder, and an appropriate direction of rotation. That is, an even number of idler gears will provide for the same direction of rotation as the direction of turning movement of the handle 32. An odd number of gears will provide a reverse direction of rotation. However, the gear housing 38 could have an idler gear train with more, e.g. four or some other (preferably even) number of idler gears. While the material of the knob socket 26, handle 32, gear housing 38, and idler gears 40, 42 is not critical, they may be conveniently fabricated from Nylon polymer material. Typically, the screws are metal, for example, chrome plated steel.

FIG. 8 shows the gear housing 38. In particular, the axles 58, 60 on which the idler gears 42, 44 are rotatably mounted can be seen. Posts (not shown) on a gear housing cover section 38A fit into the four mounting holes 62, 64, 66 and 68 formed in housing section 38B. Preferably, the posts are integrally formed on the gear housing cover section 38A, and the axles 58, 60 are integrally formed on the gear housing section 38B. The gear housing section 38B is intersected by cylindrical cavities 70, 72 in which the knob socket integral gear 28 and the handle integral gear 34 are received, respectively.

In using the musical instrument string winder 10, the knob recess 30 of the musical instrument string knob socket 26 is engaged with the guitar knob 12 and the substantially flat gripping portion 36 of the handle 32 is grasped and rotated around the guitar knob and knob socket common axis 52, without allowing the handle 32 to rotate.

Although the invention has been described with reference to a preferred embodiment, the foregoing description is not intended to be construed in a limiting sense. For example, the exemplary embodiment is shown with a guitar, but the invention can be used with other musical stringed instruments. The application of the tool is described as for loosening or tightening, and while the tool is especially useful for changing strings, the tool also provides an advantage during tuning. Various modifications to the disclosed structure and method, as well as alternative applications will be suggested to persons skilled in the art by the foregoing specification and illustrations. It is therefore contemplated that the appended claims will cover any such modifications, applications, or embodiments which fall within the true scope of the invention.

What is claimed is:

1. A musical instrument string winder for engaging a musical instrument knob for tightening or loosening a musical instrument string, said musical instrument string winder comprising:

a knob socket having first and second end portions, a knob gear integrally formed on one end portion and a recess formed on the other end portion for engaging a musical instrument knob, said knob gear having a predetermined number of teeth;

a handle having first and second end portions, a handle gear integrally formed on one end portion and an operator gripping portion integrally formed on the other end portion, said handle gear having a predetermined number of teeth; and, a gear housing having first and second cavities receiving said knob gear and said handle gear, respectively, said handle gear being coupled in driving engagement with said knob gear, whereby the musical instrument string winder can produce rotation of the musical instrument knob in response to operator rotation of the handle.

2. The musical instrument string winder of claim 1, said predetermined number of teeth of said handle gear being at least more than half the number of teeth of said knob gear.

3. The musical instrument string winder of claim 1, said handle gear and said knob gear having an equal number of teeth, whereby the musical instrument string winder can provide two rotations of the musical instrument knob for every one rotation of the handle.

4. The musical instrument string winder of claim 1, said handle gear having more teeth than said knob gear, whereby the musical instrument string winder can provide more than two rotations of the musical instrument knob for every one rotation of the handle.

5. The musical instrument string winder of claim 1, including first and second idler gears mounted for rotation on said gear housing, said first and second idler gears being disposed in meshed engagement with each other and with the knob gear and the handle gear, respectively.

6. The musical instrument string winder of claim 5, said gear having first and second mating sections, first and second axles integrally formed on one of said housing sections, said first and second idler gears being rotatably mounted on said first and second axles, respectively.

7. The musical instrument string winder of claim 1, wherein said handle, said knob socket, and said gears are fabricated from moldable polymer material.

8. The winder tool of claim 1, wherein the musical instrument strings are guitar strings and the musical instrument knob is a guitar knob.

9. A musical instrument string winder for engaging a musical instrument knob for the purpose of tightening or loosening a musical instrument string, said winder tool comprising:

a knob socket having first and second end portions, a knob gear formed on one end portion and a recess formed on the other end portion for engaging a musical instrument knob, said knob gear having a predetermined number of teeth;

a handle having a first and second end portions, a handle gear formed on one end portion and an operator gripping portion formed on the other end portion, said handle gear having a predetermined number of teeth;

a gear housing having first and second cavities receiving the knob gear and the handle gear, respectively, and having first and second axles disposed between said first and second cavities; and, first and second idler gears mounted on said first and second axles, respectively, said first and second idler gears being disposed in meshed engagement with each other and in meshed engagement with said knob gear and said handle gear, respectively.

10. A musical instrument string winder as defined in claim 9, the number of teeth on the handle gear being at least more than half the number of teeth on said knob socket gear.

11. A musical instrument string winder as defined in claim 9, wherein said handle gear and said knob gear have an equal number of teeth.

12. A method for musical instrument string winding utilizing a musical instrument string winder to engage a musical instrument knob for tightening or loosening a musical instrument string, said method comprising:

engaging a musical instrument knob with a musical instrument string winder, said musical instrument string winder having a knob socket with a gear formed on one end thereof and a recess for engaging a musical instrument knob formed on another end thereof, said winder also having a handle with an integral gear formed on one end thereof and a substantially flat gripping portion having a longitudinal axis formed on another end thereof, with said handle gear being coupled in driving engagement with said knob socket gear; and, holding said substantially flat gripping portion of said handle and rotating said handle around said musical instrument knob substantially without allowing said handle to rotate about its longitudinal axis, thereby producing rotation of the musical instrument knob.

* * * * *